US005787644A

United States Patent [19]

Thomsen, Jr.

[11] Patent Number: 5,787,644

[45] Date of Patent: Aug. 4, 1998

[54] POWER WINDOW MECHANISM

[76] Inventor: H. J. Thomsen, Jr., 440 Saddle La., Grosse Pointe Woods, Mich. 48236

[21] Appl. No.: 789,948

[22] Filed: Jan. 27, 1997

[51] Int. Cl.[6] ..... E05F 11/44

[52] U.S. Cl. ..... 49/351; 49/362; 49/348

[58] Field of Search ..... 49/348, 349, 350, 49/351, 502, 360, 362; 296/146.2

[56] References Cited

U.S. PATENT DOCUMENTS

| | | | |
|---|---|---|---|
| 3,324,594 | 6/1967 | Hettinger et al. | 49/362 X |
| 4,698,938 | 10/1987 | Huber | 49/362 X |
| 4,821,589 | 4/1989 | Fukumoto et al. | 49/349 X |
| 4,905,413 | 3/1990 | Kuki et al. . | |
| 4,920,698 | 5/1990 | Friese et al. | 49/362 X |
| 4,930,255 | 6/1990 | Sea | 49/349 X |
| 5,015,030 | 5/1991 | Detloff | 49/362 X |
| 5,076,014 | 12/1991 | Cuyl . | |
| 5,207,393 | 5/1993 | Marscholl | 49/349 X |
| 5,294,097 | 3/1994 | Thomsen et al. . | |

FOREIGN PATENT DOCUMENTS

| | | | |
|---|---|---|---|
| 126058 | 11/1947 | Australia | 49/349 |
| 427207 | 3/1926 | German Dem. Rep. | 49/351 |

*Primary Examiner*—Jerry Redman

*Attorney, Agent, or Firm*—Harness, Dickey & Pierce, P.L.C.

[57] ABSTRACT

An automotive vehicle door assembly includes a door window mechanism which is powered by an electric motor. The electric motor is located within the body of the vehicle and not within the door assembly to simplify the construction of the door assembly and allow for additional structure to support side impact loading. The drive motor and the door window mechanism include driving and driven fittings, respectively, which engage when the vehicle door is closed.

9 Claims, 2 Drawing Sheets

POWER WINDOW MECHANISM

FIELD OF THE INVENTION

The present invention relates to drive systems for the power windows of a vehicle. More particularly, the present invention relates to drive systems for the power windows of a vehicle where the drive motor is located externally to the door assembly.

BACKGROUND OF THE INVENTION

Power windows for automotive vehicles is a popular option on a large number of vehicle models and is standard equipment on the higher or luxury models. The drive systems for these power windows is contained in each door assembly and includes a drive motor, a complex mechanism for converting the rotational movement of the drive motor into longitudinal movement of the window and a window assembly including a sheet of glass. In addition, power cables leading to the drive motor must be routed through the body of the vehicle and into the door assembly to provide power for the motor. The routing of these cables must allow for the opening and closing of the door adding more to the cost and complexity of the system.

As vehicles become smaller and/or more stylish, the space available for housing these drive systems continues to decrease. In addition to size and/or styling concerns, the automotive industry is moving towards side impact standards which require the vehicle structure to withstand a specific amount of side impact in order to protect the vehicle occupants. In order to meet these side impact standards, additional structure is being added to the door assemblies. The addition of this additional structure further limits and further complicates the incorporation of power window drive systems into vehicle door assemblies. These space limiting considerations are leading to smaller and more complex drive assemblies which increases the costs to the manufacturer which are then passed on to the consumer.

Accordingly, there is a need for a power window drive system which is compatible with the space limitations which are being realized while reducing the costs associated with the manufacture of the systems.

SUMMARY OF THE INVENTION

The present invention provides the art with a power window drive system which removes the drive motor from the door assembly. The removal of the motor from the door assembly eliminates concerns over space limitations and allows for the simplification of the window lifting mechanism. The simplification of the window lifting mechanism is made possible by the elimination of design compromises which need to be made because of the limitations of where the motor can be located within the door assembly. In addition, the removal of the drive motor allows for the addition of structure to increase the structural integrity of the door, it eliminates the need to supply electrical power and its associated wiring to the door and it allows the drive motor for the power window to be positioned in an area of the vehicle which is more accessible for service requirements.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
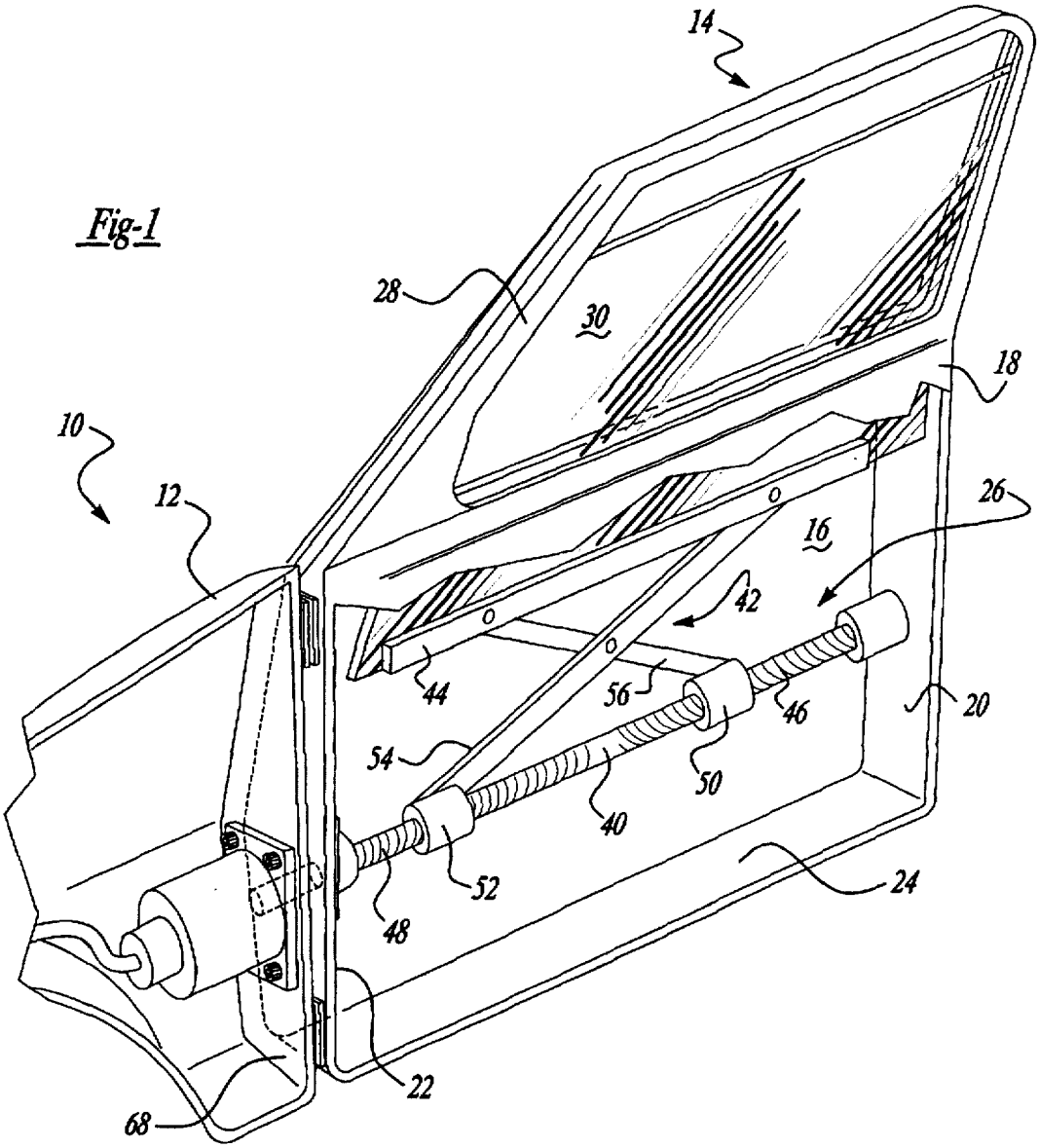
FIG. 1 is a cut-away partial perspective view of the side and door assembly of an automotive vehicle incorporating the power window mechanism in accordance with the present invention.

Referring now to the drawings in which like reference numerals designate like or corresponding parts throughout the several views, there is shown in FIG. 1, a portion of a vehicle incorporating the power window mechanism in accordance with the present invention which is designated generally by the reference numeral 10. Vehicle 10 comprises a body 12 and a door assembly 14. Only a portion of vehicle 10 is shown and it is understood that vehicle 10 includes a plurality of wheels, a suspension system between the wheels and body 12, a plurality of doors and other features typical of an automobile but which are not specifically related to the present invention.

Door assembly 14 is a typical door and it is to be understood that all of the door assemblies associated with vehicle 10 will be similar to door assembly 14. Door assembly 14 comprises an outside wall 16, an inside wall 18, and a pair of end walls 20, 22 which together define a frame having an internal chamber 24 and a door window mechanism 26. The upper portion of door assembly 14 defines a window frame 28 within which a glass plate 30 is located. Glass plate 30 is a part of door window mechanism 26 and is movable between a closed position where glass plate 30 is located within frame 28 and an open position where glass plate 30 is located within internal chamber 24. While door assembly 14 is being illustrated for exemplary purposes with an integral window frame 28, it is to be understood that window frame 28 can be eliminated or that window frame 28 can be incorporated partially or entirely within body 12 of vehicle 10 if design considerations require it.

Door window mechanism 26, preferably comprises a drive assembly in the form of a screw drive 40 rotatably supported by end walls 20 and 22, a scissor assembly 42 and a window support 44 for holding and supporting glass plate 30. Screw drive 40 includes both a right hand threaded portion 46 and a left hand threaded portion 48. A pair of nuts 50 and 52 are threadingly received on threaded portions 46 and 48, respectively, such that rotation of screw drive 40 in one direction causes nuts 50 and 52 to move away from each other while rotation of screw drive 40 in the opposite direction causes nuts 50 and 52 to move together.

Nuts 50 and 52 are each connected to a separate arm 54 and 56, respectively, of scissor assembly 42. The opposite ends of arms 54 and 56 are slidably connected to window support 44. The movement of nuts 50 and 52 cause the scissor action of scissor assembly 42 which in turn lowers or raises window support 44 and glass plate 30. Specifically when screw drive 40 is rotated such that nuts 50 and 52 move away from each other, the upper and lower portions of scissor assembly 42 are moved apart which lowers window support 44 and glass plate 30. Likewise, when screw drive 40 is rotated such that nuts 50 and 52 move toward each other, the upper and lower portions of scissor assembly 42 are moved together which raises window support 44 and glass plate 30.

While door window mechanism 26 is being shown comprising a drive assembly in the form of screw drive 40, scissor assembly 42 and window support 44, it is to be understood that other drive mechanisms such as a worm gear and plane gear drive system, a gear driving system or other drive mechanism can be substituted for door window mechanisms 26 as will be appreciated by one skilled in the art.

Figure 2:
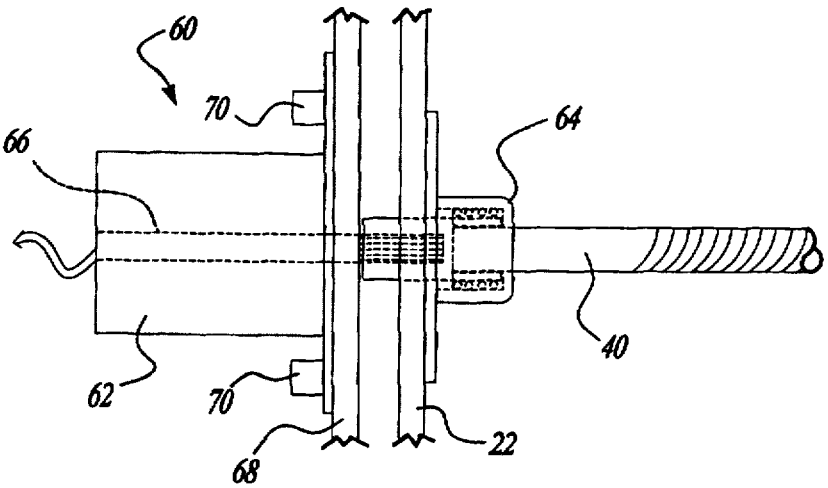
FIG. 2 is a side view showing the drive system shown in FIG. 1.
Figure 3:
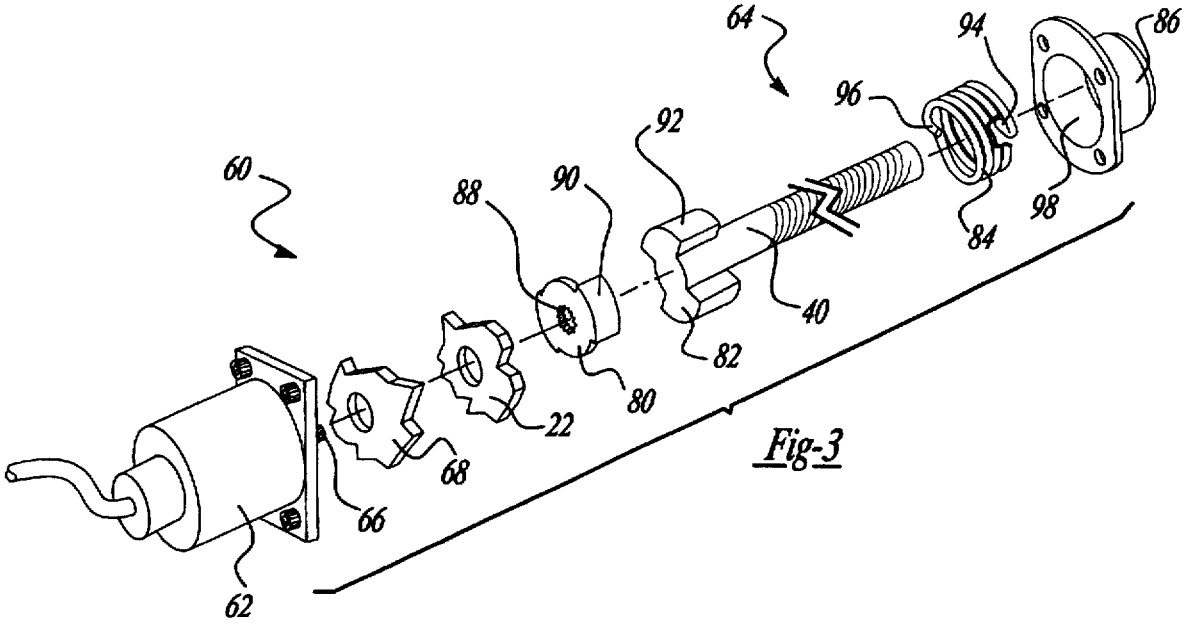
FIG. 3 is an exploded perspective view of the power window mechanism shown in FIG. 1.

Referring now to FIGS. 2 and 3, a power window drive assembly 60 is shown which powers screw drive 40 when window support 44 and thus glass plate 30 is to be raised or lowered. Power window drive assembly 60 comprises a drive motor 62 and a brake assembly 64. Drive motor 62 is shown housed within body 12 immediately adjacent to door assembly 14. Drive motor 62 is an electrical motor having a drive shaft 66 which is capable of being driven in both a clockwise direction and a counterclockwise direction. Drive motor 62 is secured to an end panel 68 of body 12 using a plurality of fasteners 70. While drive motor 62 is being shown for exemplary purposes as being secured to end panel 68 of body 12, it is to be understood that drive motor 62 may be placed at other more accessible positions within vehicle 10 and drive shaft 66 can comprise a flexible drive shaft for delivering rotation to brake assembly 64 if desired.

Brake assembly 64 comprises a driving lug 80, a driven lug 82, a locking spring 84 and a housing 86. Driving lug 80 defines an aperture 88 which matingly accepts drive shaft 66 when door assembly 14 is in its closed position. When door assembly 14 is opened, drive shaft 66 disengages from aperture 88. Driving lug 80 has a pair of driving tabs 90 which engage with locking spring 84 as will be described later herein.

Driven lug 82 is secured to screw drive 40. FIGS. 2 and 3 show driven lug 82 as being integral with screw drive 40 although driven lug 82 could be a separate component which drivingly engages screw drive 40 if desired. Driven lug 82 has a pair of driven tabs 92 which engage with locking spring 84 as will be described later herein.

Locking spring 84 is a tightly wound coil spring which includes a pair of ends 94 and 96 both of which project radially into the internal diameter formed by spring 84.

Housing 86 includes an internal diameter 98 which is similar in size to the outside diameter of locking spring 84. Locking spring 84 is positioned within housing 86 along with driving lug 80 and driven lug 82. This assembly is then secured to wall 22 of door assembly 14 such that aperture 88 will mate with drive shaft 66 when door assembly 14 is closed. During the assembly of housing 86 to wall 22 or the positioning of screw drive 40 within door assembly 14, the driving connection between driven lug 82 and screw drive 40 is made.

One driving tab 90 of driving lug 80 engages end 94 and the opposite driving tab 90 engages end 96 on the portion of ends 94 and 96 located opposite to the direction of winding for locking spring 84. Thus, when driving lug 80 is driven in a clockwise direction, one tab 90 will contact end 94 and attempt to further wind locking spring 84. In a similar manner, when driving lug 80 is driven in a counterclockwise direction, the opposite tab 90 will contact end 96 and again attempt to further wind locking spring 84. Thus, when drive motor 66 is driven in either a clockwise or a counterclockwise direction, driving lug 80 will attempt to further wind locking spring 84 or make smaller in diameter and locking spring 84 will slip against internal diameter 98 within housing 86 and rotational drive will be transmitted to screw drive 40 in both directions.

One driven tab 92 of driven lug 82 engages end 94 and the opposite driven tab 92 engages end 96 on the portion of ends 94 and 96 located towards the direction of wind for locking spring 84. Thus, when driven lug 82 is driven in a clockwise direction, one tab 92 will contact end 98 and attempt to unwind locking spring 84. In a similar manner, when driven lug 82 is driven in a counterclockwise direction, the opposite tab 90 will contact end 94 and again attempt to unwind locking spring 84. Thus, when window support 44 and thus glass plate 30 is at a partially open or fully opened position, any attempt to raise or lower glass plate 36 by applying a load to glass plate 36 will result in the rotation of driven lug 82 through window support 44, nuts 50 and 52 and screw drive 40. In either direction, driven lug 82 will attempt to unwind locking spring 84 or make larger in diameter and locking spring 84 will tighten against internal diameter 98 within housing 86 and act as a brake to resist the movement of glass plate 30.

Thus, it can be seen that by locating motor 66 within body 12 outside of door assembly 14, interior chamber 24 is only required to house door window mechanism 26 and thus door window mechanism 26 can easily be designed to avoid the beams and other structure being added to door assembly 14 to withstand side impacts. In addition, the electrical wiring required for the prior art power window systems has been removed from door assembly 14. Drive motor 62 can be located anywhere within body 12 and drive shaft 66 can include a flexible drive cable (not shown) to position drive shaft 66 at the appropriate position for engaging with driving lug 80. Similarly, driven lug 82 can be attached to a flexible drive cable (not shown) which extends between driven lug 82 and door window mechanism 26 if design considerations for the system do not permit a solid shaft connection between driven lug 82 and screw drive 40.

While the above detailed description describes the preferred embodiment of the present invention, it should be understood that the present invention is susceptible to modification, variation and alteration without deviating from the scope and fair meaning of the subjoined claims.

What is claimed is:

1. A vehicle comprising:

a body;

a door assembly pivotably secured to said body, said door assembly comprising:

a frame;

a window support mounted for generally longitudinal movement within said frame;

a glass plate supported by said window support;

a drive assembly disposed within said frame, said drive assembly operative to cause said longitudinal movement of said window support; and a drive motor disposed exterior to said door assembly, said drive motor drivingly engaging said frame.

2. The vehicle according to claim 1 wherein, said drive motor is disposed within said body of said vehicle.

3. The vehicle according to claim 1 wherein, said door assembly is movable between an open position and a closed position, said drive motor drivingly engaging said drive assembly only when said door assembly is in said closed position.

4. The vehicle according to claim 1 wherein, said drive assembly comprises:

a screw drive rotatably supported by said frame;

a nut threadingly engaging said screw drive; and an arm disposed between said nut and said window support.

5. The vehicle according to claim 4 further comprising a brake mechanism disposed between said screw drive and said frame.

6. The vehicle according to claim 5 further comprising a clutch mechanism disposed between said screw drive and said frame.

7. The vehicle according to claim 1 wherein, said drive assembly comprises:

a screw drive rotatably supported by said frame;

a pair of nuts threadingly received by said screw drive; and a scissor assembly disposed between said pair of nuts and said window support.

8. The vehicle according to claim 7 further comprising a brake mechanism disposed between said screw drive and said frame.

9. The vehicle according to claim 8 further comprising a clutch mechanism disposed between said screw drive and said frame.

* * * * *